US005205856A

United States Patent [19]

Prinz et al.

[11] Patent Number: 5,205,856

[45] Date of Patent: Apr. 27, 1993

[54] INOCULATION WIRE

[75] Inventors: Bruno Prinz, Oberursel; Karl-Josef Reifferscheid, Karben; Thomas Schulze, Altenstadt, all of Fed. Rep. of Germany

[73] Assignee: Skw Trostberg Aktiengesellschaft, Trostberg, Fed. Rep. of Germany

[21] Appl. No.: 834,430

[22] Filed: Feb. 12, 1992

[30] Foreign Application Priority Data

Feb. 14, 1991 [DE] Fed. Rep. of Germany ..... 4104562

[51] Int. Cl.[5] ..... C22C 33/00

[52] U.S. Cl. ..... 75/304; 420/22; 420/23

[58] Field of Search ..... 75/304; 420/22, 23

[56] References Cited

U.S. PATENT DOCUMENTS

| | | | |
|---|---|---|---|
| 2,881,068 | 4/1959 | Bersh | 420/23 |
| 3,056,190 | 10/1962 | Chisholm et al. | 29/182.5 |
| 3,415,642 | 12/1968 | Matsumoto | 420/23 |
| 3,421,887 | 1/1969 | Kusaka | 420/22 |
| 4,035,892 | 7/1977 | Ototani | 75/304 |
| 4,698,095 | 10/1987 | Ototani | 75/304 |

OTHER PUBLICATIONS

Giesserei, vol. 76, No. 3, Feb. 6, 1989, Düsseldorf, Germany, pp. 69 to 73.

Giesserei-Praxis, No. 21, Nov. 6, 1983, Berlin, Germany pp. 313 to 320.

Fonderie, Fondeur D'Aujourd'Hui, No. 70, Dec. 1987, Paris, France, pp. 49 to 53.

*Primary Examiner*—Peter D. Rosenberg

*Attorney, Agent, or Firm*—Felfe & Lynch

[57] ABSTRACT

The present invention provides an inoculation wire consisting of a hollow wire, containing powdered ferrosilicon, with a sheeth of steel, copper, nickel or aluminum alloy, for the production of cast iron with spheroidal graphite or vermicular graphite, wherein the filling contains 1 to 50% by volume of powdered magnesium silicide.

7 Claims, 2 Drawing Sheets

INOCULATION WIRE

FIELD OF THE INVENTION

The present invention is concerned with an inoculation wire for the production of cast iron with spheroidal or vermicular graphite which consists of a hollow wire containing a powdered ferrosilicon with a mantle of steel, copper, nickel or aluminum alloy.

BACKGROUND OF THE INVENTION

As is known, cast iron melts are treated with pure magnesium or magnesium intermediate alloys in order to achieve a spheroidal or vermicular formation of the graphite in the cast iron matrix and thereby to influence in an advantageous manner the mechanical-technological properties of the properties of the workpieces cast therefrom.

In the case of the production of cast iron with spheroidal graphite or vermicular graphite, the after-treatment of the cast iron melts by inoculation with special inoculation alloys is conventionally a part of the production technique in order to satisfy the increasing demands of quality, in which case especially ferrosilicon alloys (DIN 17560; company brochure of GfE Gesellschaft für Elektrometallurgie mbH, Düsseldorf, May, 1989; company brochure of Metallgesellschaft AG, Frankfurt, Metallurgie and Giessereitechnik, June, 1979, pp. 10–11) are very frequently used inoculation agents. The danger of carbide formation is prevented by the nucleation action of the inoculation agent. The action is based on the fact that the inoculation agent forms nuclei for the separation of the graphite. Furthermore, due to the high silicon content in the inoculation agent, the solubility of the carbon is locally reduced so that the separating out of the graphite in the case solidification is made easier. An overcooling of the cast iron melts is clearly reduced, the number of eutectic cells or spherulites is increased and thus the microstructure is more finely grained. The small addition of inoculation agent of about 0.05 to a maximum of 1.0% corresponds to a take up of silicon by the melt of 0.05 to 0.80%. For the limitation of the silicon take-up, as well as of the temperature loss of the melts, the aim is, inter alia, to use small amounts of inoculation agents but very effective inoculation agents. By means of the addition of inoculation agents, mechanical and physical properties, such as tensile strength, toughness and elasticity, are improved.

Since the inoculation effectiveness of the inoculation agent is subject to a chronological diminution effect, the addition of the inoculation agent should take place as shortly as possible before the solidification, for example by the use of the mould treatment process. It is also known to place powdered ferrosilicon alloys into comparatively thin-walled hollow wires of steel, copper, nickel or aluminum alloys (company brochure of INFORM-Impfdraht, Chemetall GmbH, Frankfurt, March, 1988). The inoculation wire is rolled off at a constant speed into the cast iron melt or is introduced into the pouring stream of molten metal in the case of the pouring off of the melt. Since the end of the inoculation wire to be melted off is present in the cast iron melt or pouring stream of molten metal, an ideally uniform addition and a controlled distribution of the inoculation agent in the melt takes place.

A diminution effect also occurs in the case of the treatment of the cast iron melt with magnesium or magnesium alloy which is the stronger when, under operational conditions, the time interval between the treatment and the casting of the melt is greater than after the treatment of the melt with an inoculation agent. For this reason, the treatment of the cast iron melt with magnesium or magnesium alloy is always to be carried out with an excess of magnesium. This excess is only of limited effectiveness since the diminution effect is simultaneously increased.

OBJECTS OF THE INVENTION

Therefore, it is an object of the present invention further to improve the accuracy in the case of the production of products of cast iron with spheroidal graphite or vermicular graphite and, for this purpose, to provide an inoculation wire of the initially described construction, the filling of which brings about a distinct increase of the inoculation effect in comparison with inoculation agents of ferrosilicon alloys and also reduces the diminution effect involved with the treatment of magnesium.

DESCRIPTION OF THE INVENTION

Thus, according to the present invention, there is provided an inoculation wire consisting of a hollow wire, containing powdered ferrosilicon as filling, with a mantle of steel, copper, nickel or aluminum alloy for the production of cast iron with spheroidal graphite or vermicular graphite, wherein the filling contains 1 to 50% by volume of powdered magnesium silicide.

In the case of contact of the inoculation wire according to the present invention with the cast iron melt, the mantle of the hollow wire dissolves completely and liberates the inoculation agent mixture forming the filling and consisting substantially of ferrosilicon alloy and magnesium silicide. This leads to a considerable increase of the nuclei in the base cast iron melt and, at the same time, strengthens the action of the magnesium on the formation of spheroidal graphite and vermicular graphite.

In technical practice in foundries, it has been found that a treatment agent of magnesium silicide in the stoichiometric composition of the formula $Mg_2Si$ (63.4% by weight of magnesium) can, in the case of treatment of cast iron melts, bring about an uncontrolled and vigorous course of the reaction because of the relatively high content of magnesium. For this reason, the magnesium silicide used for the filling of the hollow wire according to the present invention preferably has a composition of 55 to 63% by weight of magnesium and 36.6 to 45% by weight of silicon.

In order to achieve a quiet and controlled course of the reaction, it is advantageous when the stoichiometric content of silicon (36.6% by weight) in the magnesium silicide is not gone below. Therefore, the magnesium silicide preferably contains a small excess of silicon.

Especially preferably, a magnesium silicide is used which is composed of 58 to 62% by weight of magnesium and 37 to 42% by weight of silicon.

A content of rare earth metals of up to 1% by weight and preferably of from 0.5 to 0.75% by weight in the magnesium silicide strengthens the spheroidal graphite-forming action of the magnesium, as well as the quiet course of the reaction. A quiet and controlled course of the reaction is a necessary prerequisite for a sure adjustment of a desired content of residual magnesium in the cast iron melt in the case of simultaneously high magnesium yields.

Furthermore, the filling of the inoculation wire can additionally contain 1 to 15% by weight of carbon and/or 1 to 50% by weight of silicon carbide.

BRIEF DESCRIPTION OF THE DRAWINGS

The present invention is described in the following in more detail by way of example with reference to the accompanying drawings in which.

Figure 2:
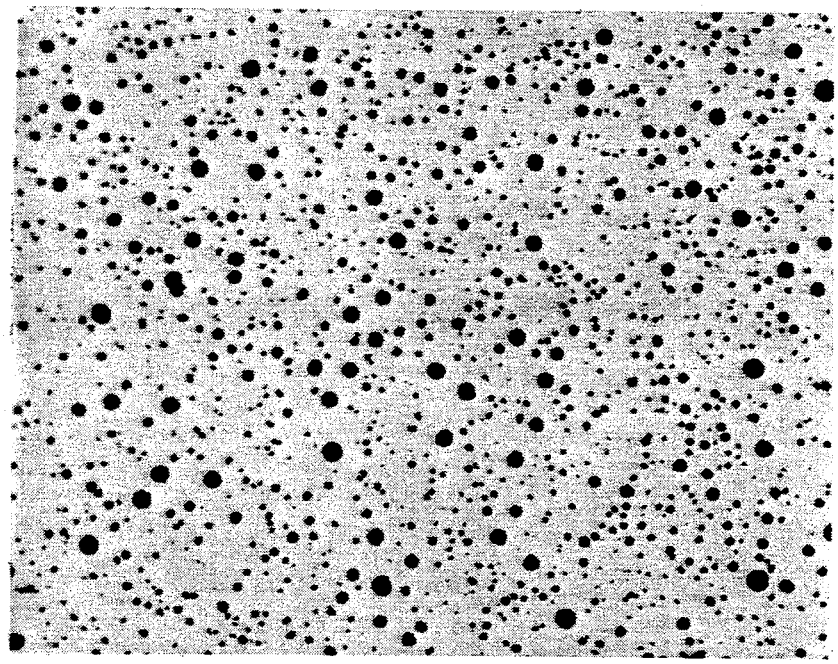
FIG. 1 illustrates in 100 fold enlargement the microstructure of cast iron with spheroidal graphite in pearlitic grey base mass which has been treated in conventional manner with inoculation wire filled with FeSi alloy and FIG. 2 illustrates in 100 fold enlargement the microstructure of cast iron with spheroidal graphite in pearlitic grey base mass which has been treated with inoculation wire according to the present invention filled with a mixture of FeSi alloy and magnesium silicide.
Figure 1:
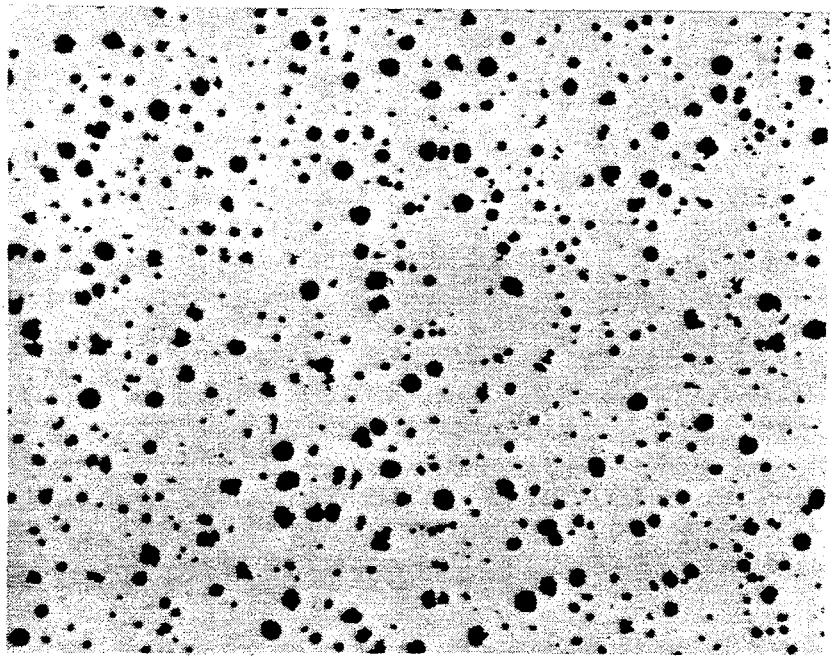

A comparison of the microstructure images shown in FIGS. 1 and 2 shows the evident grain-fining action of magnesium silicide according to FIG. 2. The quantitative microstructure analysis of the microstructure of cast iron with spheroidal graphite according to FIGS. 1 and 2 shows that the number of spherulites, recognisable as black point, of 511/mm$^2$ according to FIG. 1 has more than double to 1256/mm$^2$ according to FIG. 2, whereby, as FIG. 2 shows, the individual spherulities of the cast iron with spheroidal graphite treated with the inoculation wire made according to the present invention are distinctly smaller.

Figure 3:
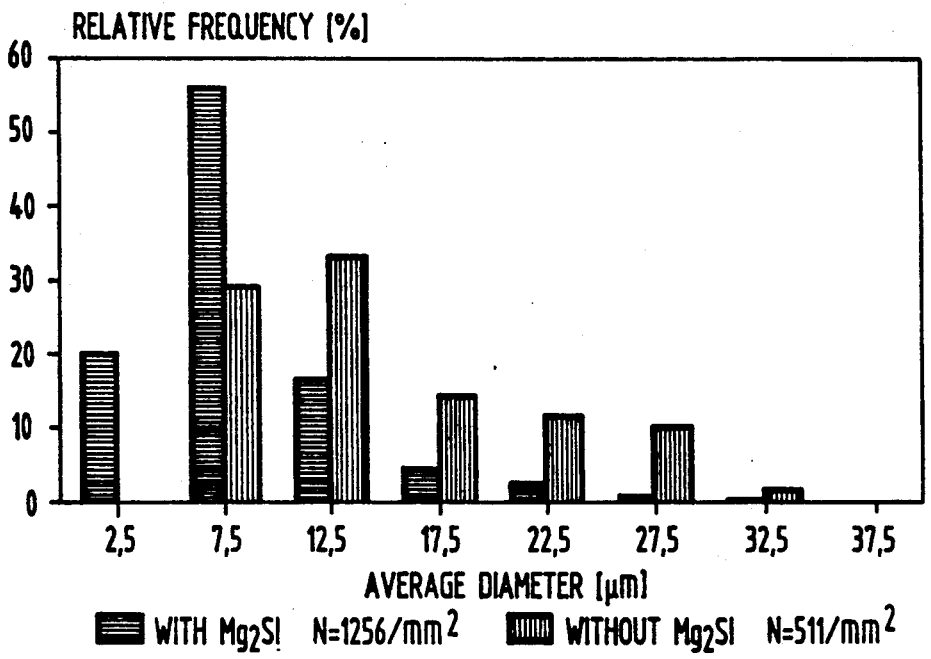

FIG. 3 illustrates this influence in a bar graph which shows the dependency of the average diameter of the spherulites upon their relative frequency. There is given a distinct shift of the diameters of the spherulites of the cast iron treated with the inoculation wire according to the present invention with spheroidal graphite towards smaller diameters.

Figure 4:
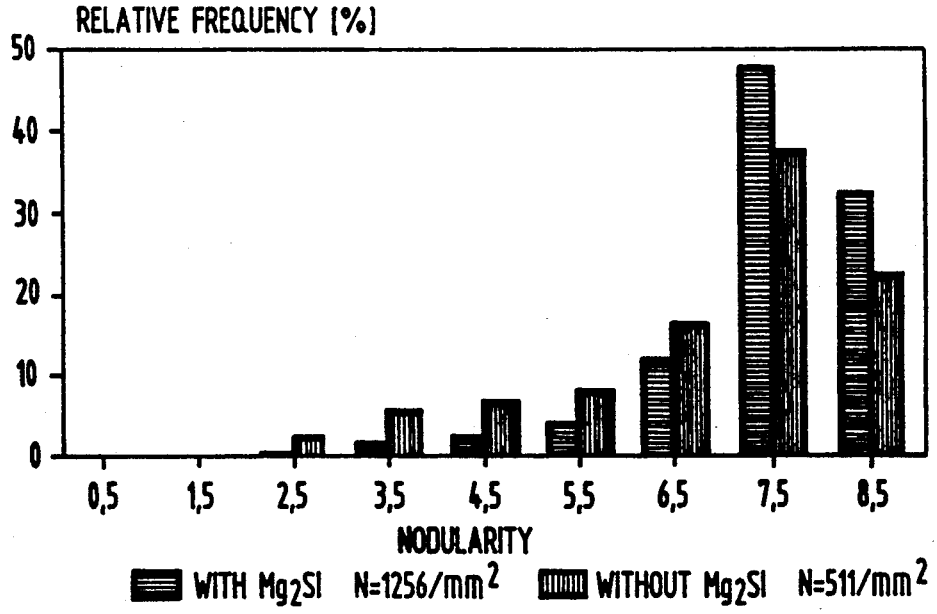

FIG. 4 shows a bar graph from which it follows that, in the case of the cast iron treated with the filled wire according to the present invention with spheroidal graphite, the nodularity of the individual spherulites also clearly increases. This means that the tendency to a retrogradation of the spherulites, characterized by the number of spherulites with smaller nodularity, distinctly decreases correspondingly.

We claim:

1. An inoculation wire for the production of cast iron with spheroidal graphite or vermicular graphite, said wire consisting of a sheath of steel, copper or nickel filled with a composition comprising powdered ferrosilicon and 1 to 50% by volume of powdered magnesium silicide.

2. Inoculation wire according to claim 1, wherein the magnesium silicide is composed of 55 to 63% by weight of magnesium and 36 to 45% by weight of silicon.

3. Inoculation wire according to claim 2, wherein the magnesium silicide is composed of 58 to 62% by weight of magnesium and 37 to 42% by weight of silicon.

4. Inoculation wire according to claim 1, wherein the magnesium silicide contains 0.01 to 1% by weight of rare earth metals.

5. Inoculation wire according to claim 4, wherein the magnesium silicide contains 0.50 to 0.75% by weight of rare earth metals.

6. Inoculation wire according to claim 1, wherein the filling additionally contains 1 to 15% by weight of carbon and/or 1 to 50% by weight of silicon carbide.

7. Process for the production of cast iron with spheroidal graphite or vermicular graphite, wherein inoculation wire according to any of claim 1 is added to a cast iron melt as shortly as possible before solidification.

* * * * *